United States Patent [19]

Antonio

[11] Patent Number: 4,726,085

[45] Date of Patent: Feb. 23, 1988

[54] SUPPORT DEVICE FOR INFANTS

[76] Inventor: Karen E. K. Antonio, 3 Running Stream Rd., Rehoboth, Mass. 02769

[21] Appl. No.: 907,853

[22] Filed: Nov. 28, 1986

[51] Int. Cl.[4] ..... A47G 9/00

[52] U.S. Cl. ..... 5/434; 5/490; 2/49 R; 297/393

[58] Field of Search ..... 5/436, 434, 435, 490; 297/393, 391, 392; 2/49 R, 49 A, 52; 128/DIG. 23

[56] References Cited

U.S. PATENT DOCUMENTS

| | | | |
|---|---|---|---|
| 1,497,756 | 6/1924 | Jones | 2/49 R |
| 2,614,199 | 11/1954 | Sanders | 2/49 R |
| 2,629,870 | 3/1953 | Hudson | 2/49 R |
| 3,597,763 | 8/1971 | Bienvenu | 2/49 R |
| 4,236,264 | 12/1980 | Britzman | 5/435 |
| 4,617,691 | 10/1986 | Monti et al. | 5/436 |

*Primary Examiner*—Alexander Grosz
*Attorney, Agent, or Firm*—Robert J. Doherty

[57] ABSTRACT

A support for a baby's head including a fabric covered foam member adapted to receive the baby's neck in a generally U-shaped inset. The fabric covering extends beyond the covered member and terminates in a pair of flaps which are adapted for positioning behind the baby so as to assist in positioning the support. When the baby nods, its head contacts the covered member in a supporting fashion.

1 Claim, 5 Drawing Figures

SUPPORT DEVICE FOR INFANTS

The "CUDDLE CUSHION" is a cushion device to be used in caring for babies aged newborn through the toddler stage.

It is designed to provide additional support and comfort for the baby's head and neck, at times when the baby is likely to fall asleep in a semi-sitting or reclining position. For example: when the baby is in an infant swing, car seat, newborn carrier type seat, etc.

The "CUDDLE CUSHION" is made of a soft, pliable yet self-supporting foam about one-inch in thickness and an overall planar configuration. The foam includes a generally U-shaped cut or inset extending into the planar foam body from the rear edge thereof and adapted to receive the baby's neck, that is, the baby's neck projects into the U-shaped opening, and the foam body extends forwardly and to the sides of the baby's head in a shelf-like configuration such that when the baby downwardly nods its head forwardly or to either side as when drowsy or falling asleep the shelf formed by the foam body contacts the baby's head and softly but comfortably supports it. In other words the device of the present invention provides cushioning and some support, should the baby's head fall either to the front, or to either side, while sleeping in a semi-sitting or reclining position. The "CUDDLE CUSHION" is covered in a soft, washable material with flaps that extend down the baby's back, to be tucked behind the baby, so that it is held in place solely by the baby's own weight. There is a slit in the material covering the cushion, at the center of the "U", so that the cover can easily be removed and laundered. The foam can also be washed, if necessary, water squeezed out, and set out to dry.

The "CUDDLE CUSHION" is intended to be used with adult supervision, as in any aspect of caring for a baby. It is designed as a comfort/support device only, and is not intended for use as a safety device.

The above-indicated objectives of the invention are carried out by the device described in the attached drawings in which FIG. 1 is a front planar view of the supporting device of my invention with the positioning flaps thereof in an extended and supported position;

DETAILED DESCRIPTION OF THE PREFERRED EMBODIMENT

Figure 1:
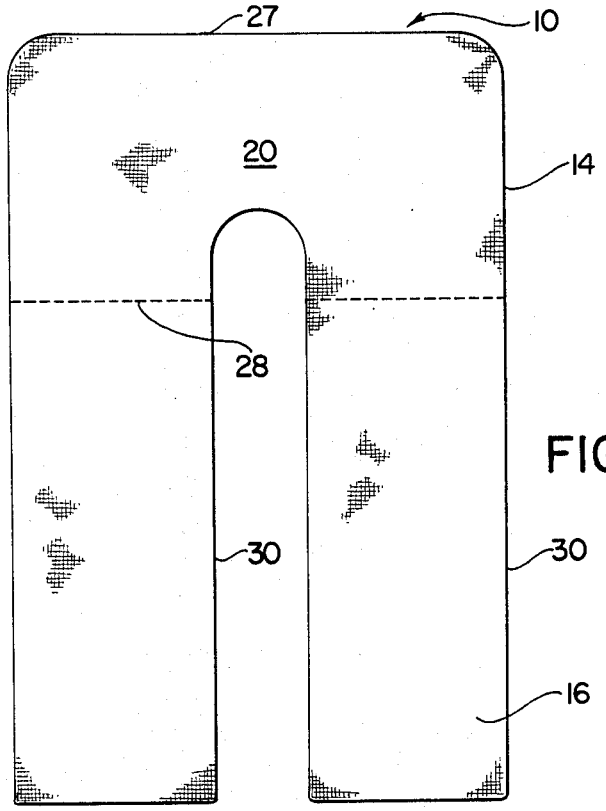
Figure 2:
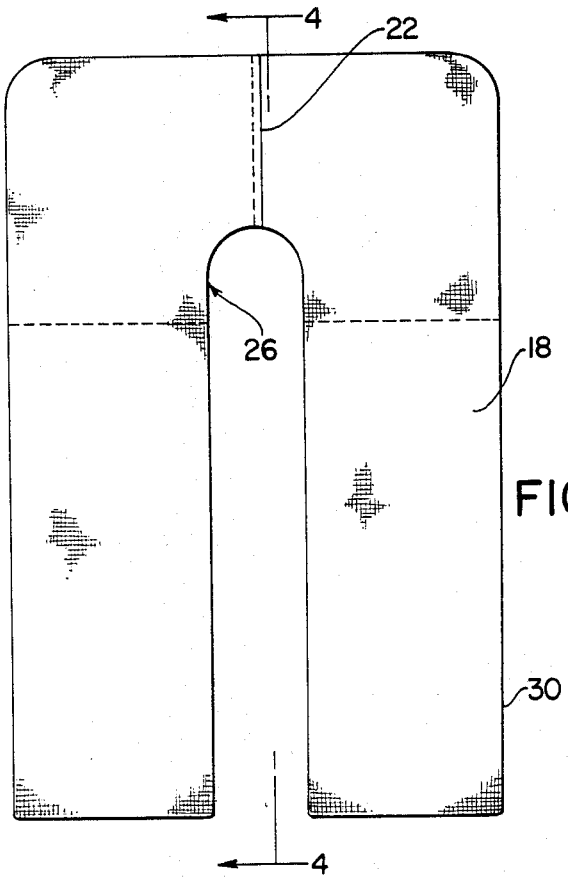
FIG. 2 is a rear planar view similar to FIG. 1.
Figure 3:
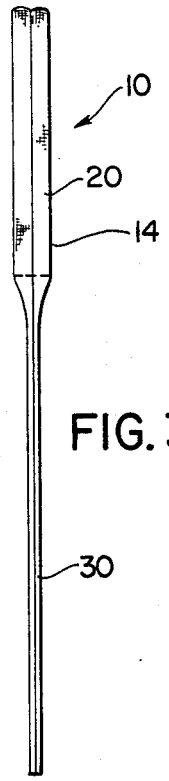
FIG. 3 is a side view of the device shown in FIG. 1.
Figure 4:
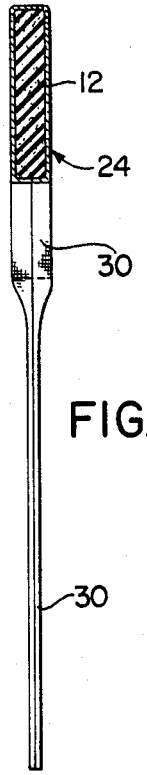
FIG. 4 is a side sectional view taken along the line 4—4 of FIG. 3.

Referring to the drawings, the device 10 of the present invention includes a self-supporting generally planar foam body or insert 12. Such body 12 is adapted for insertion into a cover 14 of a soft washable fabric having an upper surface 16 and a lower surface 18. The main forwardly disposed portion 20 of the cover 14 includes a slit 22 in the lower surface 18 through which the insert

12 may be positioned into a pocket 24 formed by the opposed surfaces 16, 18. The portion 20 as well as the insert 12 include respective forward and rear edges 27, 28.

Figure 5:
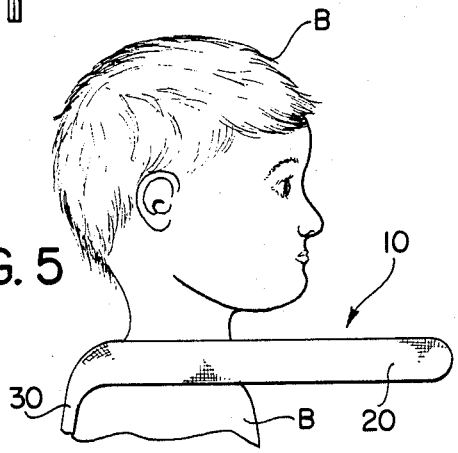
FIG. 5 is a side view showing the device of the present invention in operative position with a baby.

A generally U-shaped cut 26 extends into the body insert 12 from the rear edge 28 thereof. Such cut-out 26 as well as the similarly shaped cover 14 are adapted to receive the baby's neck as best shown in FIG. 5. The cover 14 further includes a pair of positioning flaps 30 which extend rearwardly from the forward cover portion 20. Also since there is no foam or other supporting insert in the flaps 30, they are free to fall downwardly and assume a position behind the baby's back so as to assist in positioning the device 10 upon the baby in the desired position as shown in FIG. 5. It would, of course, be possible to tie the flaps behind the baby's neck or to dimension the U-shaped cut-out to snugly fit the baby's neck, but both such positioning techniques are believed less desirable than the relatively long, relatively wide flaps 30 which are easily positionable behind the body, its bedding, the car seat interstices, etc. for support of the forward cover portion 20. Such cover portion 20, in effect, forms a self-supporting shelf partially surrounding the baby's head (generally about 270 degrees) and in spaced proximity below the baby's head such that the shelf is readily available to support the head when the baby nods forwardly or to the sides but does not interfere with the baby's vision or its ability to rest its head on whatever support is positioned to the rear (car seat, baby carriage, etc.).

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A device for supporting a baby's head when such downwardly nods to the front or side, said device comprising a fabric cover having forward and rear edges and in which a foam insert also including forward and rear edges is positioned with their respective forward and rear edges mutually engaged to form a relatively stiff, self-supporting shelf, said shelf in turn having a generally U-shaped inset extending forwardly from the respective rear edges thereof and into which the baby's neck is adapted to extend and a pair of longitudinally oriented fabric flaps rearwardly, downwardly extending from the rear edge of said cover a distance materially greater than the longitudinal extent of said shelf, said flaps being integral and a continuation of said cover and each of a width approximately that of that portion of the insert rear edge measured from the inset to the outer edge thereof, said flaps further adapted for positioning behind the baby so as to support said shelf in its operative position.

* * * * *